United States Patent [19]

Bond et al.

[11] Patent Number: 4,602,724

[45] Date of Patent: Jul. 29, 1986

[54] SHUTTER MECHANISM

[75] Inventors: Kevin J. Bond, Purbrook; Anthony L. Robinson, Gosport, both of England

[73] Assignee: De La Rue Systems Limited, Portsmouth, England

[21] Appl. No.: 557,151

[22] PCT Filed: Mar. 9, 1983

[86] PCT No.: PCT/GB83/00070

§ 371 Date: Nov. 9, 1983

§ 102(e) Date: Nov. 9, 1983

[87] PCT Pub. No.: WO83/03152

PCT Pub. Date: Sep. 15, 1983

[30] Foreign Application Priority Data

Mar. 9, 1982 [GB] United Kingdom ..... 8206869

[51] Int. Cl.[4] ..... E05G 7/00

[52] U.S. Cl. ..... 221/12; 49/28

[58] Field of Search ..... 221/277, 12, 21; 109/19; 49/28; 232/44; 194/DIG. 26

[56] References Cited

U.S. PATENT DOCUMENTS 3,901,366 8/1975 Schuller .
4,251,009 2/1981 McLaughlin .

FOREIGN PATENT DOCUMENTS

81/000219 4/1982 PCT Int'l Appl. .
2073711 10/1981 United Kingdom .
2073311 10/1981 United Kingdom .

*Primary Examiner*—Stanley H. Tollberg
*Attorney, Agent, or Firm*—Cushman, Darby & Cushman

[57] ABSTRACT

A shutter (111) and shutter control mechanism are disclosed, for use in a banknote dispensing machine for closing the outlet aperture. The shutter (111) fixed to a pivoted arm (112) is normally locked by a latch (109) which lodges in a V-shaped notch formed in the end of the shutter arm (112). When a stack of banknotes approaches the outlet aperture, a control circuit (not shown) energises an actuating solenoid (106) which pulls a drive tooth (103) through a linkage (105) against the action of a return spring (107). The drive tooth (103) rotates clockwise until it rests in the position shown in FIG. 3. During its rotation to this position, a drive pin (108) on the drive tooth (103) pushes the latch (109) away from the shutter arm, thus releasing the shutter. Meanwhile a snail cam, (104) rotates anti-clockwise, and eventually engages a cam follower surface on a lower corner of the drive tooth (103), the drive tooth being pivoted close to its center. Continued rotation of the snail cam (104) causes the drive tooth to rotate in a clockwise direction, the drive pin pushing down on the end of the shutter arm and raising the shutter. The stack of banknotes is presented at the outlet aperture, and the shutter abruptly falls under gravity to hold the stack. The drive tooth then automatically disengages, and the latch is returned (by spring 30) to lock the shutter once the stack has been withdrawn.

12 Claims, 9 Drawing Figures

11
14
10
10a
16
14
5
8
2
9
1
4
15°
20
1
20

SHUTTER MECHANISM

This invention relates to a shutter mechanism for raising and lowering a shutter, and in particular to a sheet dispensing machine incorporating such a shutter.

British patent specification No. 2073711A disclosed a banknote dispensing machine in which each of two outlet apertures is closeable by a shutter which is arranged to nip a stack of banknotes in the outlet.

The banknote dispensing machine disclosed in this prior patent specification, as illustrated in FIG. 1 of the accompanying drawings, has the disadvantage that the outlet shutter closes under gravity and is not locked securely in its closed position. It is possible that the shutter could be raised by external means, giving access to the inside of the dispensing machine.

It is therefore an object of the present invention to provide a shutter locking mechanism for a banknote dispensing machine with one or more outlets, which operates simply and reliably and which involves minimum adaptation of existing banknote dispensing machines.

A sheet dispensing machine in accordance with the present invention comprises a sheet delivery station with an outlet aperture closable by a shutter arranged to hold a stack of sheets in the outlet, shutter control apparatus, and control means for controlling the delivery of sheets to the station and the operation of the shutter control apparatus, the shutter control apparatus comprising: means cooperating with the shutter in time with the delivery of the sheets to the outlet aperture to raise the shutter before presentation of the sheets at the outlet aperture and, when the sheets have been presented, to allow the shutter to fall by gravity on to the sheets in their presentation position; and characterized by a locking member cooperating with the shutter and movable between a first position, in which it prevents the shutter from rising from its closed position, and a second position in which the shutter may be raised; and actuating means cooperating with the locking member in time with the delivery of the sheets to the outlet aperture to move the locking member from its first locking position to its second position before the sheets have been presented and thereafter allowing the return of the locking member to its first position whereby the removal of the sheets allows the shutter to fall to its closed and locked position.

Preferably, the means for raising the shutter comprise a shutter arm, attached at one end to the shutter and mounted for pivotal movement in a vertical plane; and a cam arranged for rotation in the said vertical plane and having a cam surface cooperating with the shutter arm for raising the shutter and subsequently allowing it to fall to a closed position. In the preferred embodiment, the shutter arm is attached to the shutter at one end and is pivoted at a point intermediate its ends, the shutter control apparatus further comprising a drive tooth mounted adjacent to the shutter arm for pivotal movement between actuated and neutral positions in the vertical plane, the drive tooth having at one side of its pivot point a drive pin which, with the drive tooth in the actuated position, engages the opposite end of the shutter arm, and having at the other side of its pivot point a driven edge; whereby the cam surface drives the driven edge of the drive tooth causing the drive pin to force down the end of the shutter arm thus raising the shutter.

The locking member makes the shutter secure whenever sheets, for example a stack of banknotes, are not in the region of the delivery station, i.e. they are not being delivered to the station nor waiting to be removed from the grip of the shutter. Moreover, in the preferred embodiment, the locking member is linked mechanically with the means for raising the shutter so that the locking member frees the shutter arm before the shutter is raised, but returns to lock the shutter after the shutter has been raised. A preferred embodiment of the invention will now be described, in order to clarify the invention, with reference to the accompanying drawings, wherein:

FIG. 1, filed in our International Application No. PCT/GB 81/00219, illustrates a banknote dispensing machine with two outlets, which could be adapted to incorporate the invention;

FIG. 2, also filed in the above application, is a cross-section of the same banknote dispensing machine;

Figure 1:
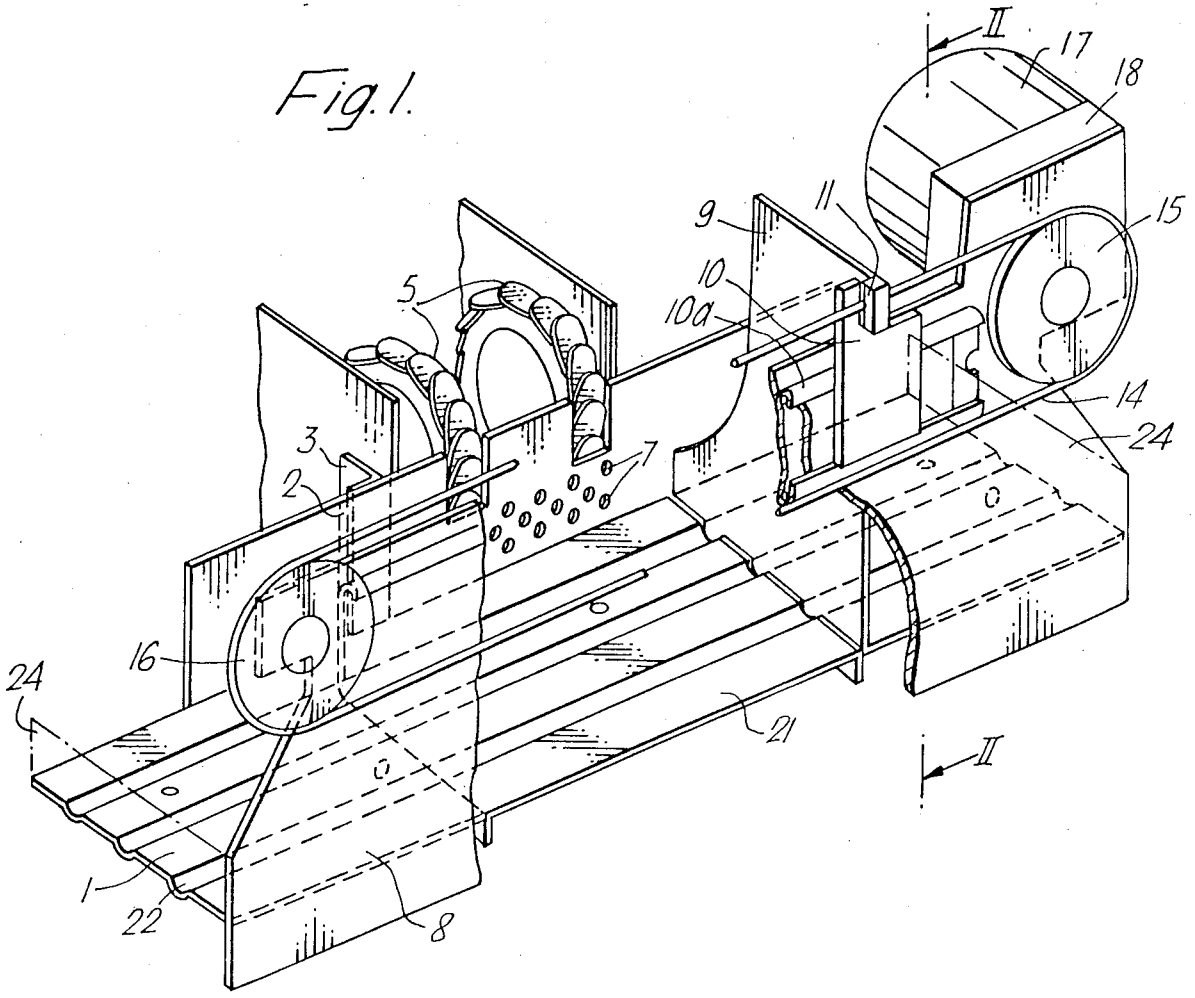
Figure 2:
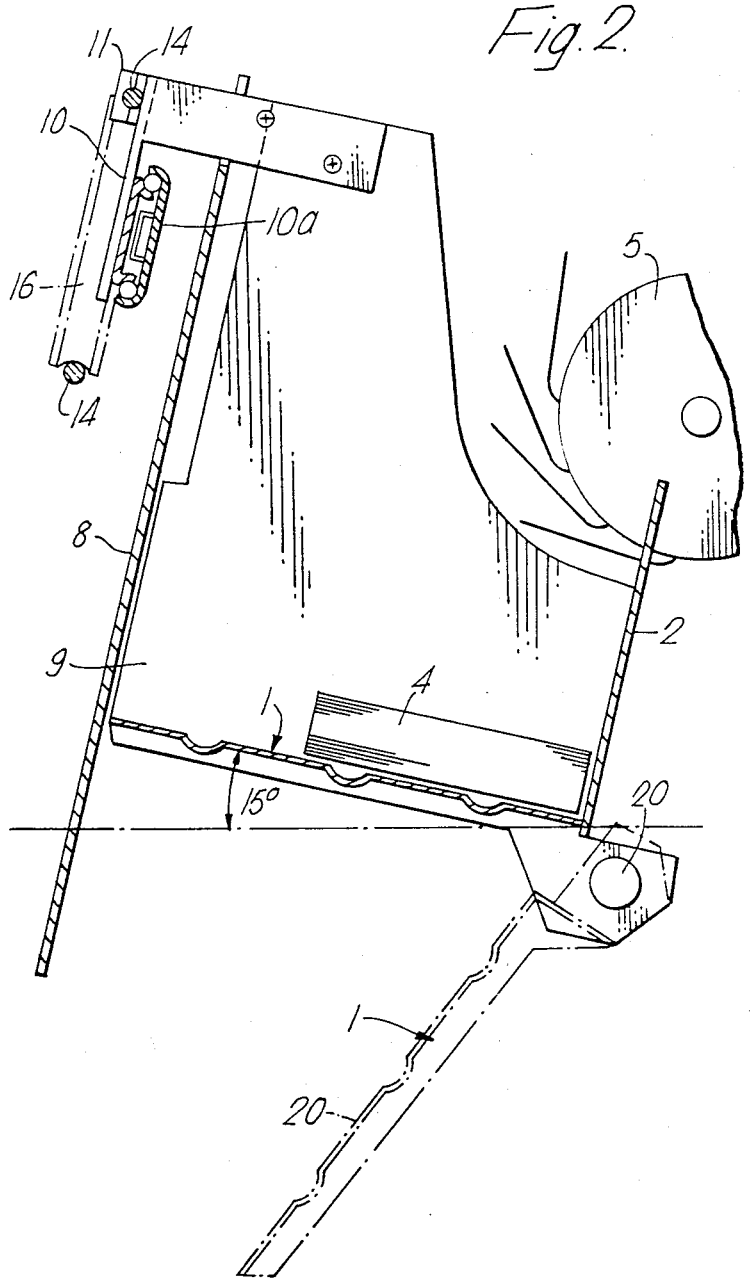

The operation of the banknote dispensing machine of FIGS. 1 and 2 will now be described briefly in order to indicate the function of the shutter. The machine is described in greater detail in our International Application No. PCT/GB81/00219 referred to above. A dispensing drive mechanism comprises a base plate 1 with a side support plate 2 at right angles thereto. The base plate is located at an angle of 15° to the horizontal, as shown in FIG. 2, so that the base plate 1 and side support plate 2 form an angled support for aligning a stack of banknotes 4 fed from a pair of tined stacking wheels 5. Parallel to the side support plate 2 is a mounting plate 8 on which a pusher plate 9 is reciprocatingly mounted to move longitudinally of the base plate 1. The pusher plate 9 is mounted at right angles to the base plate by a bracket 10 screwed to the inner member of a three member slide way 10*a*, the outer member of the slide way being secured to the mounting plate 8. The bracket 10 is clamped by a plate 11 to an endless belt 14 of circular cross section extending around two pulleys, a drive pulley 15 and an idler pulley 16, the drive pulley 15 being driven by an electric motor 17 via a gear box 18.

The centre section 21 of the base plate is hinged at 20 to the lower end of the side support plate, to pivot downwards and form a dump facility.

In operation, the automatic cash dispensing apparatus incorporating the banknote dispensing mechanism is controlled to dispense banknotes to two dispensing outlets 24. The banknotes are delivered to the stacking wheels, are then stripped from the stacking wheels and stacked in a neat pile on the angled base plate, from where they are moved by the pusher plate 9 to one of the dispensing outlets 24. If the banknotes are next to be dispensed from the left-hand outlet, then the pusher plate 9 is moved to wait close to the right-hand edge of the dump plate 21; when a stack 4 of banknotes has been deposited on the plate 21 the pusher plate 9 is moved leftwards and pushes the stack towards the outlet. If an error had been detected, for example the passage of a "double" banknote to the stack 4, then the stack can be dumped by the downwards pivoting of the dump plate 21 (shown in dotted lines in FIG. 2).

Figure 3:
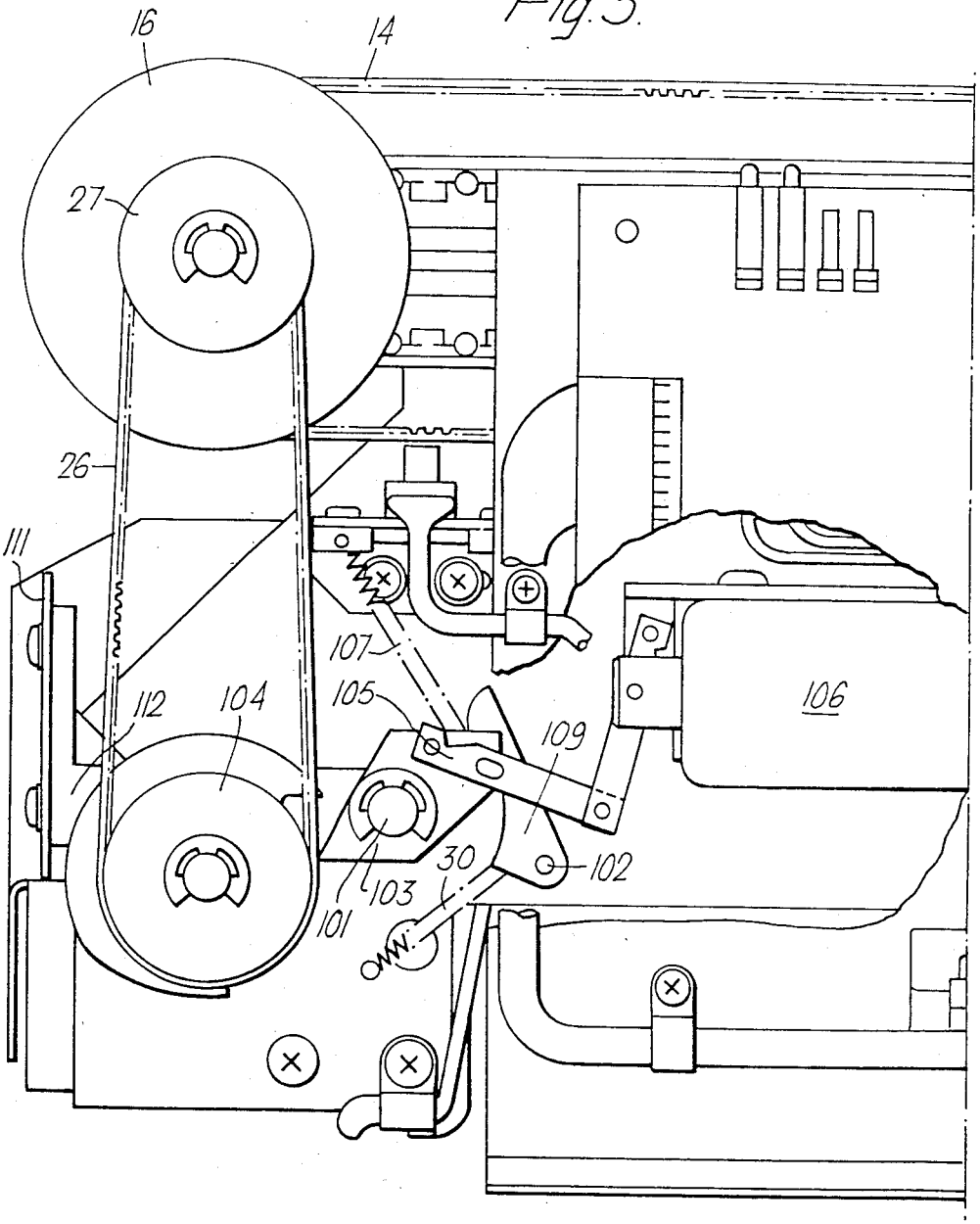
FIGS. 3 and 4 illustrate the left-hand and right-hand outlets of a banknote dispensing machine similar to that shown in FIGS. 1 and 2, including shutters and shutter control apparatus in accordance with the preferred embodiment of the invention.
Figure 4:
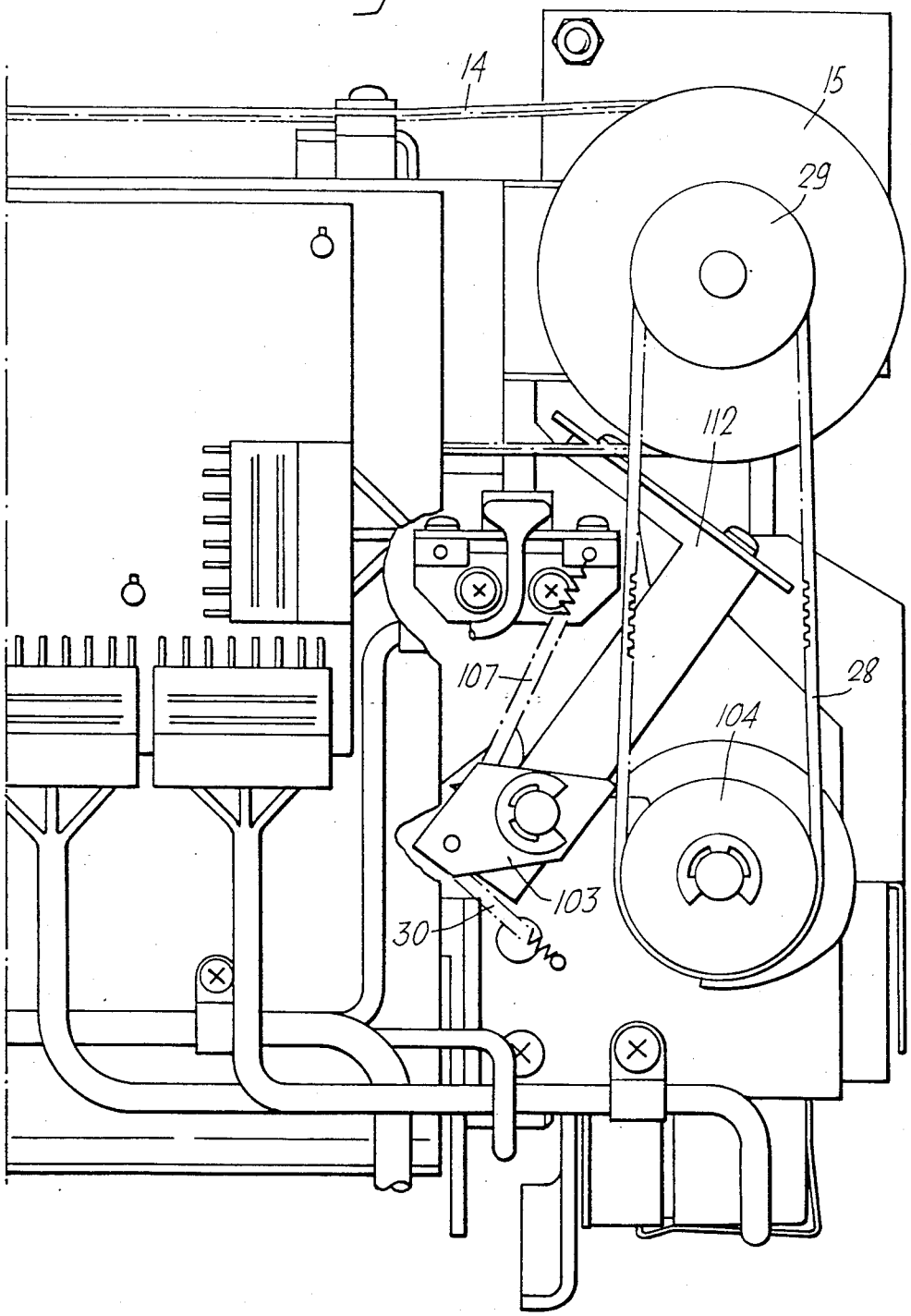

The preferred embodiment of the invention will now be described in the context of the banknote dispensing machine of FIGS. 1 and 2. FIGS. 3 and 4 show the left-hand and right-hand outlets respectively of the dispensing apparatus shown in FIG. 1. The same type of shutter control apparatus is used at each outlet, and the apparatus shown in FIGS. 3 and 4 is shown from opposite sides. The left-hand shutter, shown in FIG. 3, is in its closed and locked position, while the right-hand shutter, shown in FIG. 4, is in its fully open position in which it is just about to drop onto a stack of banknotes (not shown) at the outlet to grip the stack for presentation to an operator. The shutter and shutter control apparatus are isolated from the remainder of the dispensing apparatus, in FIGS. 5 to 8 which show it in various stages of its cycle.

The shutter 111 is mounted on a shutter arm 112 pivoted at the point 101 along its length. A snail cam 104 is mounted for rotation in either direction, and is driven by way of a toothed belt 26 (28) by a pulley 27 (29) rotating with the corresponding main drive pulley 16 (15) for the pusher plate.

Figure 5:
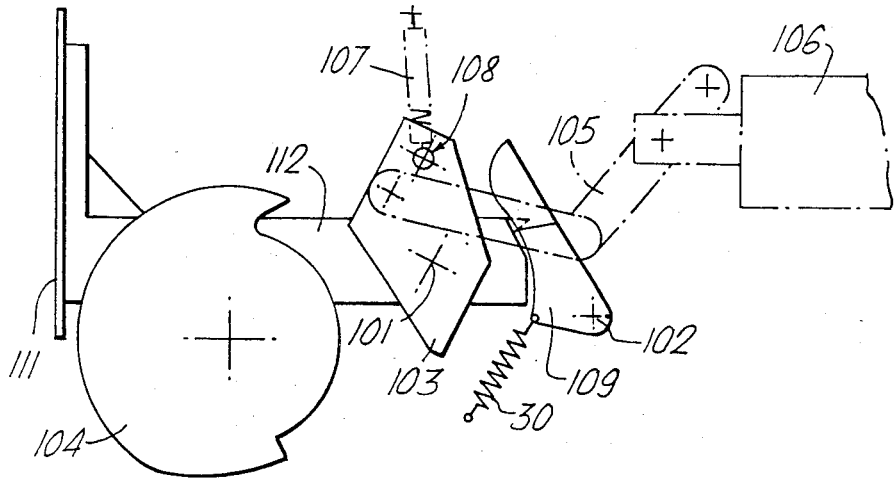
FIGS. 5 to 8 are sketches of the shutter and shutter control mechanism of FIG. 3, in various stages of its operation.

The snail cam 104 causes the shutter arm 112 to pivot by driving a cam follower edge of a drive tooth 103, which is pivotable about the point 101. In FIG. 5, the drive tooth is in a neutral position in which it is disengaged from the snail cam 104, the cam being free to rotate without raising the shutter.

The shutter is locked in its position in FIG. 5 by means of a locking member or latch 109. The latch 109 is pivoted about an axis 102 and is biased towards its locking position by a return spring 30 (tending to rotate it in an anti-clockwise direction in FIG. 3 and FIGS. 5 to 8). The latch 109 lodges in a V-shaped notch in the end of the shutter arm 112, preventing the shutter arm from rotating.

Figure 8:
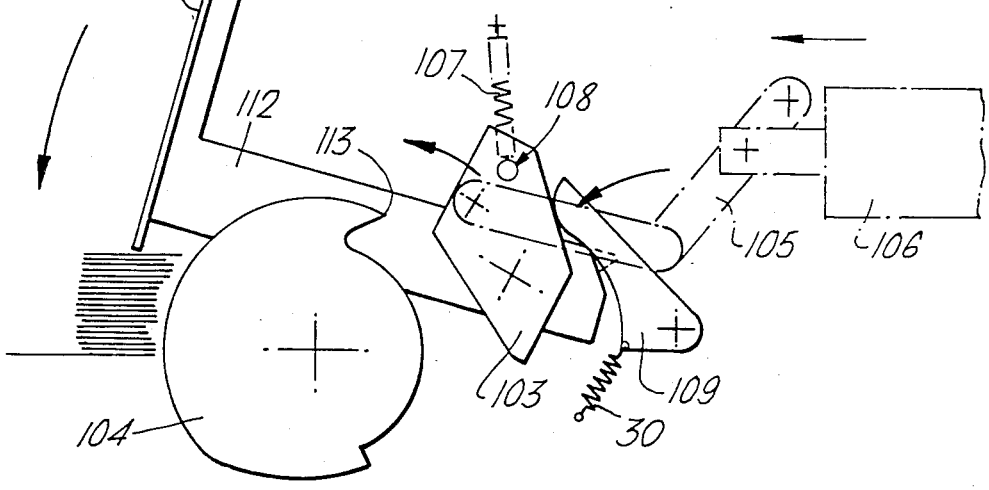
Figure 9:
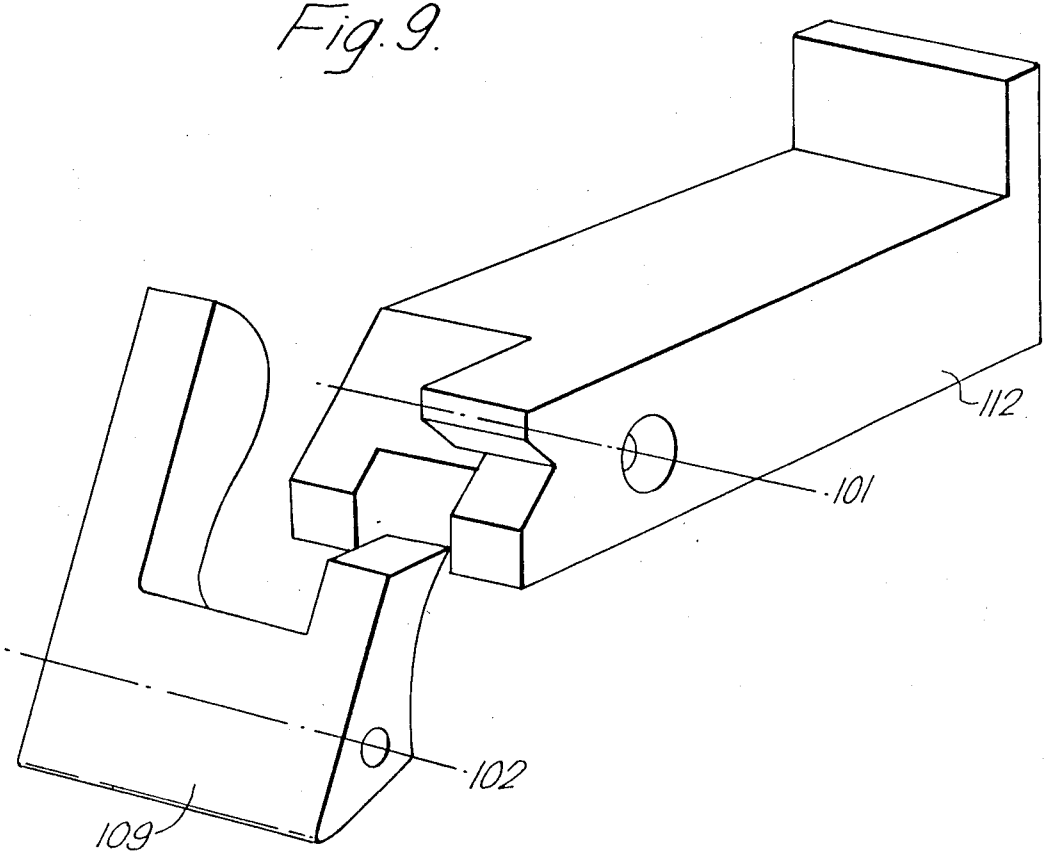
FIG. 9 is a rough sketch in perspective of a shutter arm and locking mechanism forming part of the shutter control apparatus of FIGS. 3 to 8.

FIG. 9 shows the V-shape of the notch more clearly; the V-shape is apparent in the side elevation. FIG. 9 is a perspective view of the latch 109 and the shutter arm 112 from the back, right-hand side in FIGS. 5 to 8.

Figure 6:
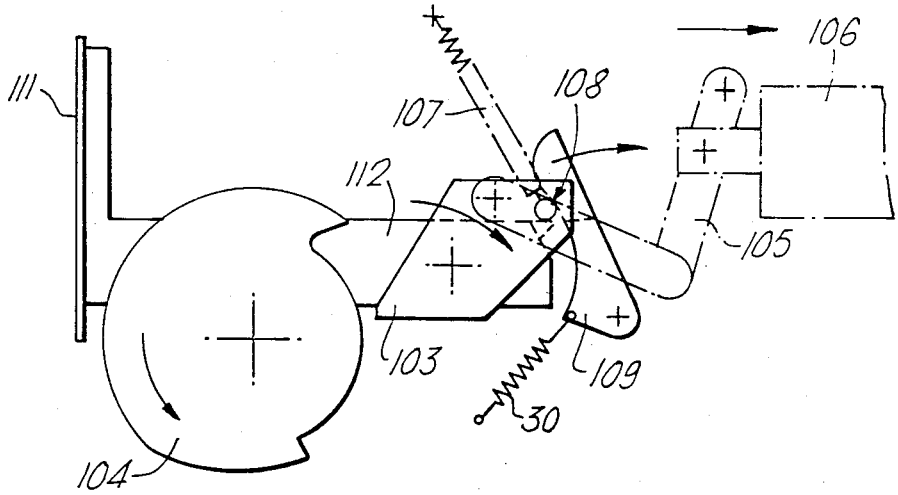
Figure 7:
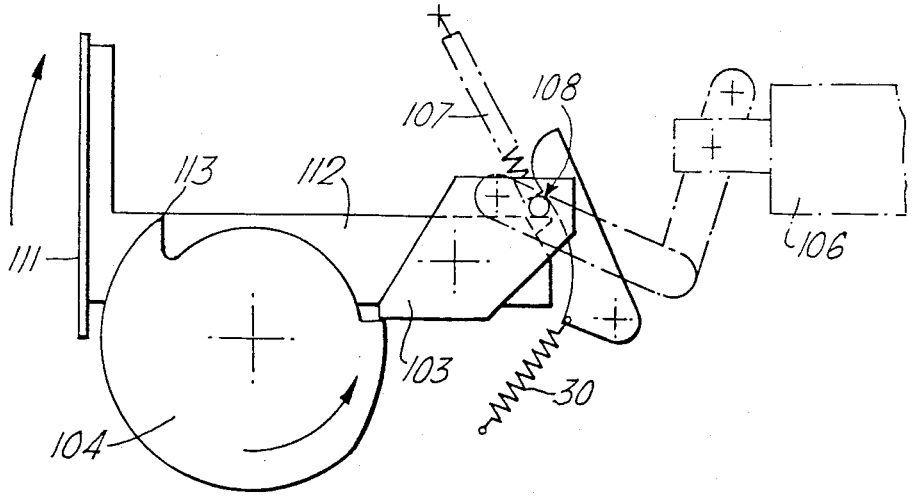

When a central microprocessor control recognises that a stack of banknotes is approaching the delivery station (this is described in greater detail in the above patent application), it causes the drive tooth 103 to move to its actuated position, shown in FIGS. 3, 6 and 7, by energising a solenoid 106 which pulls the drive tooth 103 by means of a linkage 105. The solenoid drive linkage 105 pulls against the action of a return spring 107 also attached to the same end of the drive tooth. The drive tooth 103 rotates in a clockwise direction, as in FIG. 6, until a drive pin 108 on the drive tooth rests on an upper edge of the end of the shutter arm 112. As the drive tooth rotates towards its actuated position, the drive pin 108 engages a profiled surface of the latch 109 (on the left in FIG. 9), pushing the latch in a clockwise direction (anti-clockwise in FIG. 9) and freeing the shutter arm 112 from the locking action of the latch. Once the apparatus has assumed its actuated position, as shown in FIGS. 3 and 7, energisation of the solenoid 106 is no longer necessary.

With the continued movement of the stack of banknotes towards the exit aperture, the snail cam 104 is simultaneously rotated in an anti-clockwise direction, as shown in FIG. 6. The cam surface engages a driven edge of the drive tooth 103 (see FIG. 7). As the drive tooth is pivoted close to its centre, the cam provides a clockwise torque in the drive tooth 103, and the drive pin 108 on the tooth forces the shutter arm end downwards. This causes the shutter to be raised progressively with the anti-clockwise rotation of the snail cam, until it assumes its highest postion as shown in FIG. 4.

With the continued rotation of the cam to the point where the edge 113 meets the drive edge of the drive tooth, the shutter is abruptly allowed to fall under gravity, holding the stack of banknotes at the exit aperture, as shown in FIG. 8. The return spring 107 simultaneously returns the drive tooth 103 to its neutral position, pulling the solenoid linkage 105 with it. The latch 109 also rotates in an anti-clockwise direction under the action of the return spring 30, so that when the stack of banknotes is removed the latch once again locks the shutter arm, as in FIG. 5.

The delivery of a stack of banknotes to the left-hand aperture will now be summarized. A stack is deposited on the pivotable platform 21 (FIG. 1) with the pusher plate 9 being positioned as shown in FIG. 1, just to the right of the stack. Drive pulleys 15, 16 are then rotated anti-clockwise, causing the pusher plate to move the stack leftwards and causing both snail cams 104 (FIGS. 3 and 4) to rotate in the anti-clockwise direction. At this stage, the right-hand shutter will be locked (as in FIG. 5) unless a previously-dispensed stack still remains at the right-hand aperture (as in FIG. 8). The left-hand shutter must be locked at this stage, otherwise the delivery of banknotes would have been prevented by the central microprocessor. As the stack approaches the left-hand aperture, the drive tooth is actuated (FIG. 6) and then the cam 104 begins to raise the shutter (FIG. 7). With the shutter at its highest position (FIG. 4), the stack is presented at the exit aperture, the pusher plate 9 being at its extreme position. The shutter then falls and holds the stack (FIG. 8) ready for the operator to withdraw the stack. Meanwhile the pusher plate can be returned to its next waiting position and can deliver another stack of notes, either to the same terminal again (once the said stack has been withdrawn) or to the right-hand terminal. When the pusher plate 9 moves to the right, with the cams 104 rotating clockwise, the drive tooth 103 at the left-hand terminal does not interfere with the cam 104 because it is not in its actuated position.

The invention therefore provides a simple but secure dispensing machine for sheets such as banknotes, and existing banknote dispensing machines (for example the one illustrated in FIGS. 1 and 2) can easily be modified to incorporate the invention.

We claim:

1. A sheet dispensing machine comprising a sheet delivery station with an outlet aperture closable by a shutter arranged to hold a stack of sheets in the outlet, shutter control apparatus, and control means for controlling the delivery of sheets to the station and the operation of the shutter control apparatus, the shutter control apparatus comprising: means (104, 103,108,112) cooperating with the shutter in time with the delivery of the sheets to the outlet aperture to raise the shutter before presentation of the sheets at the outlet aperture and, when the sheets have been presented, to allow the shutter to fall by gravity on the sheets in their presentation position and characterized by a locking member (109) cooperating with the shutter and movable between a first position, in which it prevents the shutter from rising from its closed position, and a second position in which the shutter may be raised; and actuating means (106,105,108) cooperating with the locking member in time with the delivery of the sheets to the outlet aperture to move the locking member from its first locking position to its second position before the sheets have been presented and thereafter allowing the return of the locking member to its first position whereby the removal of the sheets allows the shutter to fall to its closed and locked position.

2. A sheet dispensing machine in accordance with claim 1, wherein the means for raising the shutter comprise: a shutter arm (112), attached at one end to the shutter and mounted for pivotal movement in a vertical plane; and a cam (104) arranged for rotation in the said vertical plane and having a cam surface effective to raise the shutter and subsequently to allow it to fall to a closed position.

3. A sheet dispensing machine in accordance with claim 2, wherein the shutter arm (112) is attached to the shutter (111) at one end and is pivoted at a point intermediate its ends, the means for raising the shutter comprises a drive tooth (103) mounted adjacent to the shutter arm (112) for pivotal movement between actuated and neutral positions, the drive tooth having at one side of its pivot point a drive pin (108) which, with the drive tooth in the actuated position, engages the opposite end of the shutter arm, and having at the other side of its pivot point a driven edge; whereby the cam surface drives the said driven edge of the drive tooth causing the drive pin to force down the end of the shutter arm thus raising the shutter.

4. A shutter dispensing machine in accordance with claim 3, wherein the said drive pin (108) on the drive tooth (103) is also the actuating means for the locking member (109), the drive pin engaging a cam surface on the locking member such that when the drive tooth pivots into its actuated position it forces the locking member into its second position, but otherwise allows the locking member to remain in its first locking position.

5. A sheet dispensing machine in accordance with claim 2, 3, or 4, wherein the shutter control apparatus is so arranged that when the cam (104) rotates in one direction the shutter is raised, and is then allowed to fall while the drive tooth (103) and locking member (109) return to their neutral and locking positions respectively.

6. A sheet dispensing machine in accordance with claim 2, 3, or 4, wherein the said drive tooth (103), when its driven edge is not being driven by the cam (104), is returned to its neutral position by means of a return spring (107).

7. A sheet dispensing machine in accordance with claim 1, wherein the said opposite end of the shutter arm is formed with a V-notch in which the locking member locates for locking the shutter.

8. A sheet dispensing machine in accordance with claim 1, for delivering sheets to a selected one of two distinct delivery stations, each having a shutter and shutter control apparatus, the machine having a single control means which ensures that when a sheet or stack of sheets is held in one outlet there can be no delivery of a further sheet or stack of sheets to that outlet, but there can be a delivery to the other outlet if so commanded, the locking members being in their first locking positions unless sheets are being delivered to the respective aperture or have not yet been removed from the grip of the respective shutter.

9. A sheet dispensing machine in accordance with claim 5, wherein the said drive tooth (103), when its driven edge is not being driven by the cam (104), is returned to its neutral position by means of a return spring (107).

10. A sheet dispensing machine in accordance with claim 9, wherein the said opposite end of the shutter arm is formed with a V-notch in which the locking member locates for locking the shutter.

11. A sheet dispensing machine in accordance with claim 9, for delivering sheets to a selected one of two distinct delivery stations, each having a shutter and shutter control apparatus, the machine having a single control means which ensures that when a sheet or stack of sheets is held in one outlet there can be no delivery of a further sheet or stack of sheets to that outlet, but there can be a delivery to the other outlet if so commanded, the locking members being in their first locking positions unless sheets are being delivered to the respective aperture or have not yet been removed from the grip of the respective shutter.

12. A sheet dispensing machine in accordance with claim 10, for delivering sheets to a selected one of two distinct delivery stations, each having a shutter and shutter control apparatus, the machine having a single control means which ensures that when a sheet or stack of sheets is held in one outlet there can be no delivery of a further sheet or stack of sheets to that outlet, but there can be a delivery to the other outlet if so commanded, the locking members being in their first locking positions unless sheets are being delivered to the respective aperture or have not yet been removed from the grip of the respective shutter.

* * * * *